US006065174A

United States Patent [19]

Laymon

[11] Patent Number: 6,065,174

[45] Date of Patent: May 23, 2000

[54] PARABOLIC SCRAPER FOR A PIPELINE PIG

[76] Inventor: Dwane O. Laymon, P.O. Box 3489, Tulsa, Okla. 74109-3489

[21] Appl. No.: 09/200,354

[22] Filed: Nov. 10, 1998

[51] Int. Cl.[7] ..... B08B 9/04

[52] U.S. Cl. ..... 15/104.061; 15/104.068

[58] Field of Search ..... 15/104.061, 104.068, 15/104.16

[56] References Cited

U.S. PATENT DOCUMENTS

| | | | |
|---|---|---|---|
| 971,042 | 9/1910 | Hill et al. | 15/104.061 |
| 2,263,774 | 11/1941 | Heltzel et al. | 15/104.061 |
| 3,252,111 | 5/1966 | Von Arx . | |
| 3,292,197 | 12/1966 | Stephens . | |
| 3,480,984 | 12/1969 | Kidd . | |
| 3,496,588 | 2/1970 | Ver Nooy . | |
| 3,576,043 | 4/1971 | Zongker . | |
| 3,604,041 | 9/1971 | Ver Nooy | 15/104.061 |
| 3,673,629 | 7/1972 | Casey . | |
| 4,413,370 | 11/1983 | Payne et al. | 15/104.061 |
| 4,538,316 | 9/1985 | Reinhart . | |
| 4,663,795 | 5/1987 | Neff . | |
| 5,379,475 | 1/1995 | Sivacoe . | |
| 5,903,946 | 5/1999 | Collins et al. | 15/104.061 |

*Primary Examiner*—Terrence R. Till

*Attorney, Agent, or Firm*—William S. Dorman

[57] ABSTRACT

A cleaning pig comprising a forward cup, a rear cup and a connecting central body extending between the two cups, the cups having an outside diameter corresponding generally to the inside diameter of a pipeline to be cleaned by the cleaning pig, a plurality of leaf springs extending rearwardly and radially outwardly from the central body between the two cups and being connected to the central body at their inner ends, a plurality of scraper blocks attached to the outer free ends of the leaf springs and adapted to engage the inner surface of the pipeline wall and being urged resiliently against the inner surface of the pipeline wall by the leaf springs, each scraper block having an outer surface which is curved to correspond with the diameter of the pipeline wall and adapted to engage the inner surface of the pipeline wall as the cleaning pig moves forward in the pipeline, each scraper block having an inner surface opposite from the outer surface and facing the central body, each scraper block having a forward surface generally transverse to the outer surface and facing the forward direction of movement of the pipeline pig, each scraper block having a rear surface opposite from the forward surface and generally transverse to the outer surface and the inner surface of the scraper block, the forward surface connecting with the outer surface along a parabolic cutting edge for removing paraffin from the inside of a pipeline wall when the pig moves in a forward direction through the pipeline.

2 Claims, 3 Drawing Sheets

PARABOLIC SCRAPER FOR A PIPELINE PIG

BACKGROUND OF THE INVENTION

1. Field of the Invention

The present invention relates to a device mounted on a pipeline pig for scraping paraffin from the inside of a pipeline. More particularly, this invention relates to a scraper element which is preferably made of polyurethane and which is provided with a cutting edge in the shape of parabola.

2. Prior Art

The use of pipeline pigs, and their construction, has been known in the petroleum industry. Generally speaking, a pipeline pig is an apparatus which is inserted into a pipeline and travels through the line, usually by the movement of liquids or gases in the line, to accomplish purposes such as cleaning the interior of the line, removing paraffin, separating one type of fluid from another, removing entrapped water, inspecting the pipeline and so forth.

Generally, pig apparatuses of the prior art include an elongated central body member (generally metallic) and two or more cup members (sections) which are attached to the body member. Each of the cup members is made of a resilient material, and completely fills the inside of the pipeline so that the pressure of the fluid being transported through the pipeline pushes the pig apparatus through the pipeline in the direction of fluid flow.

The pipeline industry uses pipeline pigs for many purposes. Some of the pigs carry brushes or scraping elements and are used to clean the inner walls of the pipeline. Others do not carry any cleaning elements and may be used as separation pigs to separate two different fluids being consecutively passed through the pipeline .

The present invention pertains to a cleaning pig and more particularly, to a cleaning pig which is adapted to remove paraffin from the inside surface of a pipeline. The cleaning pig of the present invention does not employ cleaning brushes, but, instead, a plurality of scraping elements or scraping blocks, as described herein, each of which is preferably made of polyurethane and which is provided with a parabolic cutting edge.

There are many patents and proposals in the past which have dealt with the problem of removing paraffin and other undesirable coatings from the inside of a pipeline. A preliminary search was conducted on the present invention and the following patents were uncovered in the search.

| Patent No. | Inventor | Issued |
|---|---|---|
| 3,292,197 | Stephens | Dec. 20, 1966 |
| 3,480,984 | Kidd | Dec. 2, 1969 |
| 3,496,588 | Ver Nooy | Feb. 24, 1970 |
| 3,525,111 | Von Arx | Aug. 25, 1970 |
| 3,576,043 | Zongker | Apr. 17, 1971 |
| 3,604,041 | Ver Nooy | Sep. 14, 1971 |
| 3,673,629 | Casey | July 4, 1972 |
| 4,538,316 | Reinhart | Sep. 3, 1985 |
| 4,663,795 | Neff | May 12, 1987 |
| 5,379,475 | Sivacoe | Jan. 10, 1995 |

Some scrapers involve brushes mounted at the end of leaf springs as in Stephens U.S. Pat. No. 3,292,197, or Ver Nooy U.S. Pat. No. 3,496,588. In Reinhart U.S. Pat. No. 4,538, 316, a plurality of cutter arms are urged by springs against the pipeline wall.

SUMMARY OF THE INVENTION

The present invention includes a cleaning pig having a forward cup, a rear cup and a connecting central body extending between the two cups. The cups each have an outside diameter corresponding generally to the inside diameter of the pipeline to be cleaned. A plurality of leaf springs extend rearwardly and radially outwardly from the central body between the two cups and are connected to the central body at their inner ends slightly behind the location of the forward cup. A plurality of scraper blocks are attached to the outer free ends of the leaf springs and are adapted to engage the inner surface of the pipeline wall. These scraper blocks are urged resiliently against the inner surface of the pipeline wall by the leaf springs when the cleaning pig is moving forwardly within the pipeline. Each scraper block is provided with an outer surface which is curved to correspond with the inner diameter of the pipeline wall and adapted to engage the inner surface of the pipeline wall as the cleaning pig moves forward in the pipeline. Each scraper block is also provided with an inner surface opposite from the outer surface and facing the central body. Each scraper block is also provided with a forward surface generally transverse to the outer surface and facing the forward direction of movement of the pipeline pig. Each scraper block is provided with a rear surface opposite from the forward surface and generally transverse to the outer surface and inner surface of the scraper block. The forward surface of the scraper block connects with the outer surface along a cutting edge which bears against the inside surface of the pipeline to scrape or remove paraffin from the inside of the pipeline wall as the pig moves in a forward direction. The forward surface of the pipeline pig constitutes a shelf and the cutting edge is generally in the shape of a parabola whereby the forward edge of the pipeline pig in combination with the parabolic cutting edge provides a scooping action to remove the paraffin from the inside of the pipeline wall.

DETAILED DESCRIPTION OF THE DRAWINGS

Figure 1:
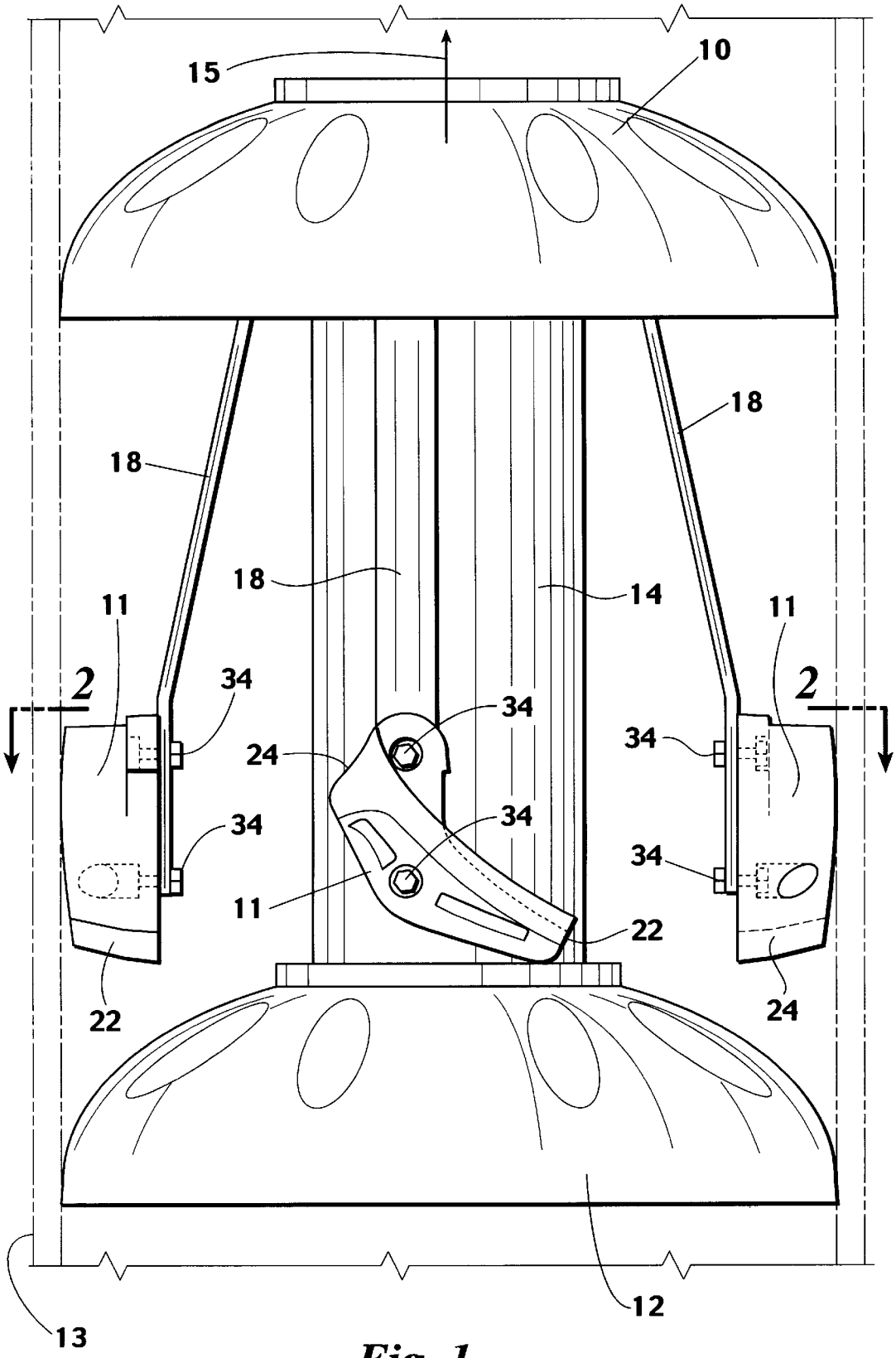
FIG. 1 is a top plan view of a cleaning pig mounted inside of a pipeline, (shown in dot and dash lines) and showing the cleaning elements of the present invention disposed between a pair of cups.

Referring to the drawings in detail, FIG. 1 shows a cleaning pig comprised of a forward cup 10, a rear cup 12 and a connecting central body 14 extending between the two cups. A plurality of scraper blocks 11 are connected to the upper end of the central body adjacent the inside of the upper pig cup 10 by means of a plurality of leaf springs 18. The leaf springs 18 are connected to the central body 14 behind the forward cup 10. The scraper blocks 11 are mounted on the free ends of the leaf springs. The cups 10 and 12 have an outside diameter corresponding generally to the inside diameter of the pipeline 13. The leaf springs 18 urge the scraper blocks 11 against the inner surface of the pipeline wall.

Figure 2:
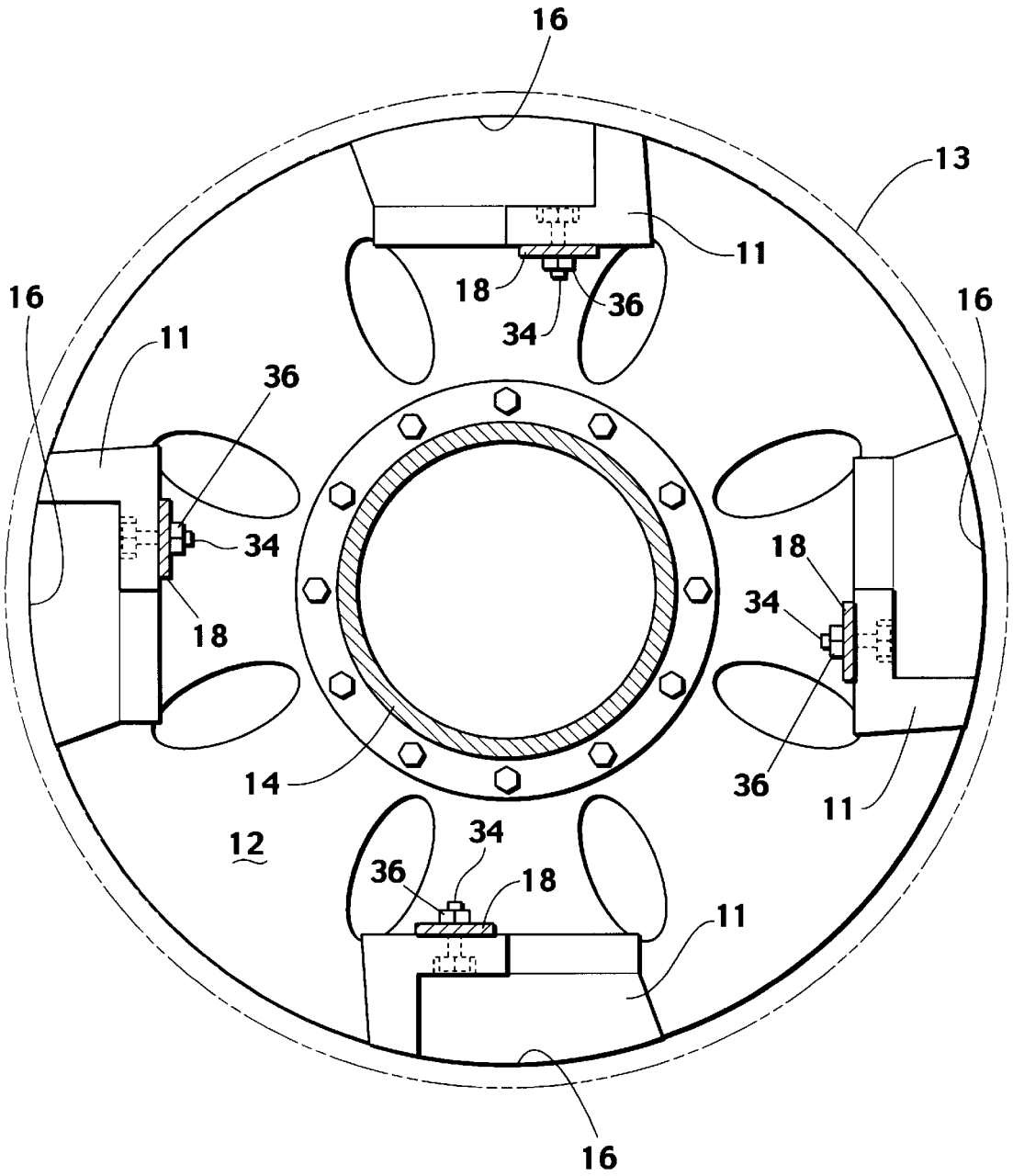
FIG. 2 is a sectional view taken along section line 2—2 of FIG. 1.

For the purpose of illustration and/or explanation, the pipeline pig shown in FIG. 1 should be considered as one adapted to traverse through a pipeline 13 having an 18" inside diameter. Each scraper block 11, therefore, has an outer surface 16 which is curved so as to conform with the inner shape of the 18" inside diameter pipe and which will bear against the inner surface of the pipeline 13 as the pig moves forward in the pipeline as best shown in FIG. 2. The opposite side or surface 17 of the scraper 11 from the curved side 16 (that is, the inner surface facing the central body 14), for example, can be flat. The upper edge of the surface 16 is formed by a cutting edge 20 which is in the shape of a parabola. Behind the cutting edge (on the top of the scraper) is a forward (upper) surface or shelf 21 which is curved downwardly and inwardly so as to provide a scooping action when the pig is passed through the pipeline. The pig will move forward in the pipeline as indicated by the arrow 15 in FIG. 1. That is, the edge 20 cuts into the paraffin while the outer surface 16 rides against the inner surface of the pipeline. The paraffin which is scraped away by the parabolic cutting edge 20 is then urged inwardly by the curved shelf 21 in a somewhat scooping action. The scraper 11 is preferably made out of a polyurethane, such as 95 shore A urethane which appears to be extremely tough and has very good wear characteristics.

Figure 5:
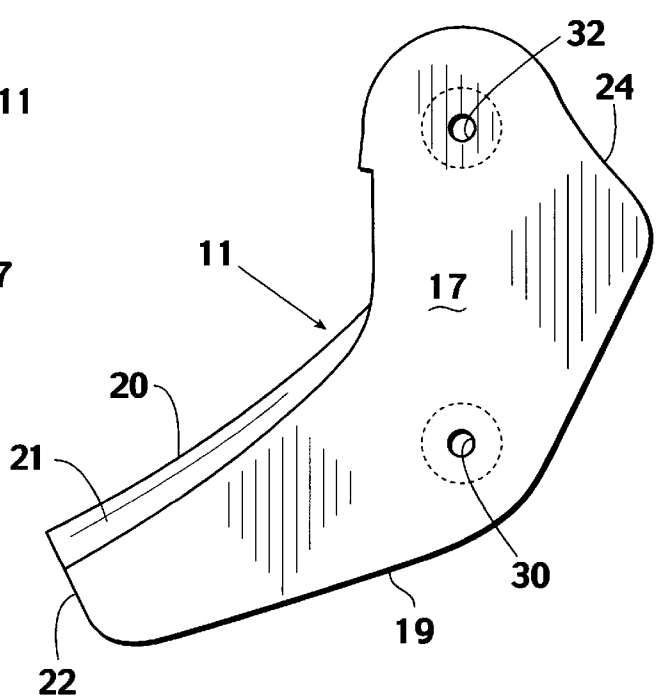
FIG. 5 is a bottom plan view of the cleaning element per se.
Figure 4:
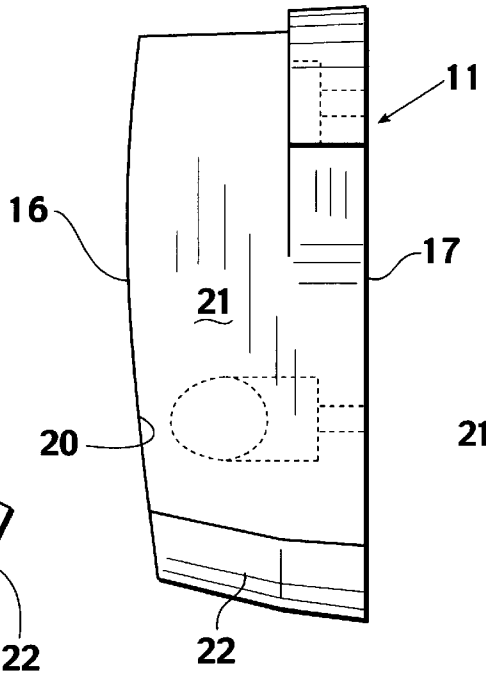
FIG. 4 is a side elevation of the cleaning element of FIG. 1 per se.
Figure 3:
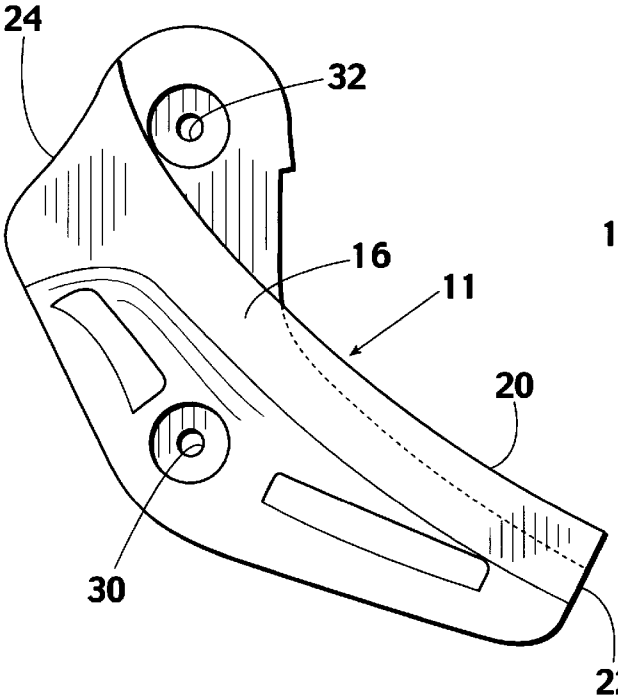
FIG. 3 is a plan view of the cleaning element per se.

The rear (lower) surface 19 (the surface opposite from the forward surface 21) can be of any shape although it is somewhat curved as shown. The rear and forward surfaces are generally transverse with respect to the outer and inner surfaces. The right-hand end (as it appears in FIGS. 3, 4, and 5) is provided with a toe portion 22 of relatively short vertical height and an opposite heel portion 24 of slightly greater vertical height.

Each scraper block 11 is provided with a pair of holes 30 and 32 to permit attachment of each block to its associated leaf spring 18 by means of bolts 34. The opposite ends of the bolts 34 are fitted with nuts 36.

Although the drawings, especially FIG. 2, show only four scraper blocks 11 associated with the pipeline pig, it should be understood that this illustration is for the purposes of simplification. Actually, a sufficient number of scraper blocks 11 will be employed in conjunction with each pipeline pig so that essentially 360 degrees of coverage will be provided by the cutting edges 20 of the scraper blocks 11 as the pig moves forwardly in the pipeline 13. For the purposes of the pipeline 13, shown in FIG. 2, it might be necessary to employ nine or ten scraper blocks 11 suspended from an equal number of leaf springs 18 which would be angularly and regularly arranged around the upper portion of the central body 14. When the scraper blocks 11 are compressed inwardly as the pig is inserted into the pipeline 13, it is preferable that the toe portion 22 of a given scraper block 11 be disposed beneath the heel portion 24 of the adjacent scraper block 11 so that the scraping action will cover 360 degrees of the inner circumference of the pipeline wall 13.

Whereas the present invention has been described in particular relation to the drawings attached here to, it should be understood that other and further modifications, apart from those shown or suggested herein, may be made within the spirit and scope of this invention.

What is claimed is:

1. A cleaning pig comprising a forward cup, a rear cup and a connecting central body extending between the two cups, the cups having an outside diameter corresponding generally to the inside diameter of a pipeline to be cleaned by the cleaning pig, a plurality of leaf springs extending rearwardly and radially outwardly from the central body between the two cups and being connected to the central body at their inner ends, a plurality scraper blocks attached to the outer free ends of the leaf springs and adapted to engage the inner surface of the pipeline wall and being urged resiliently against the inner surface of the pipeline wall by the leaf springs, each scraper block having an outer surface which is curved to correspond with the diameter of the pipeline wall and adapted to engage the inner surface of the pipeline wall as the cleaning pig moves forward in the pipeline, each scraper block having an inner surface opposite from the outer surface and facing the central body, each scraper block having a forward surface generally transverse to the outer surface and facing the forward direction of movement of the pipeline pig, each scraper block having a rear surface opposite from the forward surface and generally transverse to the outer surface and the inner surface of the scraper block, the forward surface connecting with the outer surface along a cutting edge for removing paraffin from the inside of a pipeline wall when the pig moves in a forward direction through the pipeline, the cutting edge being generally in the shape of a parabola.

2. A cleaning pig as set forth in claim 1 wherein the forward surface of the pipeline pig constitutes a shelf whereby the parabolic cutting edge of the scraper cooperates with the shelf to provide a scooping action to remove the paraffin from the inside of the pipeline wall.

* * * * *